United States Patent [19]

Moslehi et al.

[11] Patent Number: 4,715,937

[45] Date of Patent: Dec. 29, 1987

[54] LOW-TEMPERATURE DIRECT NITRIDATION OF SILICON IN NITROGEN PLASMA GENERATED BY MICROWAVE DISCHARGE

[75] Inventors: Mehrdad M. Moslehi, Palo Alto; Chi Y. Fu, San Francisco County; Krishna Saraswat, Santa Clara County, all of Calif.

[73] Assignee: The Board of Trustees of the Leland Stanford Junior University, Stanford, Calif.

[21] Appl. No.: 859,943

[22] Filed: May 5, 1986

[51] Int. Cl.[4] ..... C23C 8/24

[52] U.S. Cl. ..... 204/177; 204/192.22; 427/38; 427/45.1; 437/241

[58] Field of Search ..... 427/38, 39, 45.1, 94; 204/192.22, 164, 177

[56] References Cited

U.S. PATENT DOCUMENTS 4,277,320 7/1981 Beguwala et al. ..... 204/164

4,298,629 11/1981 Nozaki et al. ..... 427/39

*Primary Examiner*—John F. Niebling

*Assistant Examiner*—William T. Leader

*Attorney, Agent, or Firm*—Flehr, Hohbach, Test, Albritton & Herbert

[57] ABSTRACT

A process utilizing a microwave discharge technique for performing direct nitridation of silicon at a relatively low growth temperature of no more than about 500° C. in a nitrogen plasma ambient without the presence of hydrogen or a fluorine-containing species. Nitrogen is introduced through a quartz tube. A silicon rod connected to a voltage source is placed in the quartz tube and functions as an anodization electrode. The silicon wafer to be treated is connected to a second voltage source and functions as the second electrode of the anodizing circuit. A small DC voltage is applied to the silicon wafer to make the plasma current at the wafer and the silicon rod equal and minimize contamination of the film.

7 Claims, 8 Drawing Figures

LOW-TEMPERATURE DIRECT NITRIDATION OF SILICON IN NITROGEN PLASMA GENERATED BY MICROWAVE DISCHARGE

This invention was made with U.S. Government support under Army Agreement No. MDA903-84-K-0062, awarded by DARPA. The Government has certain rights in this invention.

This application is directed generally to the field of thin films for integrated circuits, and more particularly to the formation of silicon nitride films for use as ultra-thin gate, tunnel, and DRAM insulators in VLSI devices.

Due to the continuing increase in integration density of integrated circuits, and the reduction in device and circuit geometries, ultra-thin (less than or equal to 200 angstroms), high quality insulators are needed for gate insulators of IGFETs, storage capacitor insulators of DRAMs, and tunnel dielectrics in nonvolatile memories. Thermal nitrides and nitroxides prepared by direct thermal reaction of ammonia or nitrogen-containing species with silicon and silicon dioxide are of the best alternatives to thermally grown silicon dioxide for these particular applications. A number of techniques have been used previously for growth of thermal nitrides and nitroxides. These techniques include nonplasma thermal nitridation in ammonia or nitrogen ambient, rapid thermal nitridation in lamp-heated systems, high pressure nitridation, RF plasma-enhanced nitridation, and laser-enhanced nitridation. The techniques are generally summarized and reviewed in "Thermal Nitridation of Si and $SiO_2$ for VLSI", Moslehi and Saraswat, IEEE Transactions on Electron Devices, February 1985. The conventional thermal nitridation process needs fairly high temperatures to grow relatively thick silicon nitride films, and usually the thickness is limited to about 70 angstroms at the highest growth temperature.

It is an object of the present invention to define an improved process for forming nitride films on silicon for use as ultra-thin insulators.

More particularly, it is an objective of the present invention to define a process capable of growing nitride films of thicknesses up to at least 100 angstroms.

In the basic techniques typically used to date, fairly high temperatures must be used. Unfortunately, as the geometry of integrated circuits continues to shrink, the use of high temperature processing in forming nitride insulators can cause migration of the impurities used to define the physical structure of the integrated circuit device. This can have a negative impact on the performance of the finished device. Therefore, it is an objective of this invention to define a process for providing nitride films which operates at relatively low temperatures. Preferably, the process to be defined would operate without any heating of the wafer, or with heating of the wafer to about 500.

In previous works on plasma-enhanced nitridation, the plasma was normally generated by RF discharge using electrodes or coils. However, in such techniques, the growth temperatures usually exceeded 900° C. and the film thicknesses were limited to small values. Reisman, et al., in "Nitridation of Silicon in a Multi-Wafer Plasma System," Journal Electronic Materials, Vol. 13, No. 3, 1984, describes nitridation of silicon in a multi-wafer RF (400 kHz) plasma system in an Ar-$NH_3$ plasma mixture at less than or equal to 850° C., and grew very thin layers (up to 70 angstroms) of nitride films. Hezel, et al., "Silicon Oxynitride Films Prepared by Plasma Nitridation of Silicon and Their Application for Tunnel Metal-Insulator-Semiconductor Diodes," Journal Applied Physics, Vol. 56, No. 6, page 1756, 1984, used a parallel plate 30 kHz plasma reactor and a mixture of $H_2$—$NH_3$ plasma to nitridize Si at 340° C. Using this approach, they could grow up to 60 angstrom nitride films. Using a laser-enhanced technique, Sugii, et al., "Excimer Laser Enhanced Nitridation of Silicon Substrates," Applied Physics Letters, Vol. 45 (9), page 966, 1984, were able to grow less than or equal to 25 angstroms of nitride at a substrate temperature of 400° C. The enhancement of the nitridation was attributed to the photochemically generated $NH_2$ radicals by 6.4 eV laser photons. Harayama, et al., "Plasma Anodic Nitridation of Silicon in $N_2$—$H_2$ System," Journal Electrochemical Society, Volume 131, No. 3, 1984, used a plasma anodic nitridation technique to form nitride films of up to 200 angstroms thick in $N_2$—$H_2$ plasma system (13.56 MHz). Comparison of various nitridation techniques described above indicates that hydrogen was present in the plasma ambient in these projects; however, they do not present data regarding the amount of hydrogen incorporated into the composition of the grown films. Nakamura, et al., "Thermal Nitridation of Silicon and Nitrogen Plasma," Applied Physics Letters, Vol. 43(7), page 691, 1983, reported their results on thermal nitridation of silicon in nitrogen plasma (400 kHz). Under extreme nitridation conditions (1145° C., 10 hours), they could grow only 40 angstroms. Recently, Giridhar, et al., "$SF_6$ Enhanced Nitridation of Silicon in Active Nitrogen," Applied Physics Letters, Vol. 45 (5), page 578, 1984 performed thermal nitridation of silicon and active nitrogen generated by microwave discharge and grew about 20 angstroms at 1100° C. for 60 minutes of nitridation in pure nitrogen plasma. The growth kinetics were significantly increased by addition of $SF_6$ to the nitrogen ambient.

However, a difficulty with the techniques described in the references cited above is that the films are of insufficient thickness; they are formed at high temperatures; and they incorporate fluorine and/or hydrogen in the atmosphere present. The presence of these elements in the atmosphere can result in sputtering on the silicon surface resulting in deposited rather than grown films. Therefore, it is an objective of the present invention to define a process for growing thin nitride films of up to 100 angstroms thickness without incorporating fluorine or hydrogen in the nitride atmosphere.

Another objective of this invention is to grow these films at temperatures of 500° C. or less.

In brief, the present invention incorporates a process comprising direct plasma nitridation of silicon performed at low temperatures (500° C. or less) utilizing nitrogen plasma generated by microwave discharge. In a preferred embodiment, electrical connections are provided to the wafer in the plasma chamber and a silicon rod inserted in another region of the chamber to equalize the plasma currents at the wafer and minimize contamination of the film. Preferably, the anodization current is maintained at a low level, and comprises a reverse anodization current (wafer:−, Si rod:+) of a relatively small value. The microwave discharge is preferably about 2.45 GHz. The features and advantages of the present invention will be described with reference to the following figures, wherein FIG. 1 is a schematic of a microwave plasma nitridation reactor especially useful in carrying out the process of the present invention;

Figure 1:
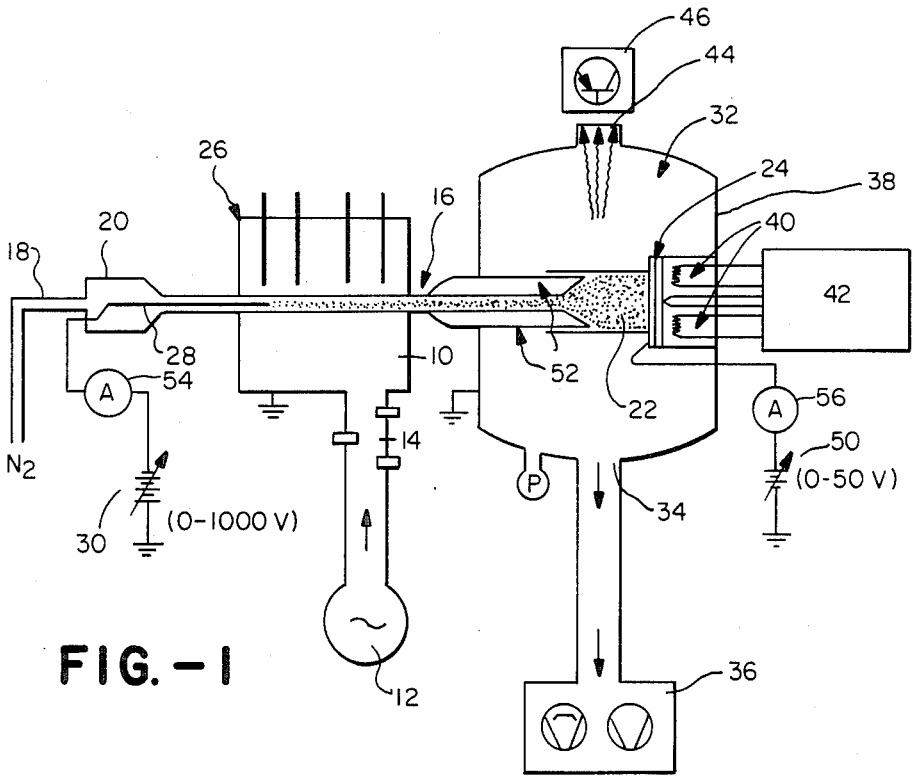

FIG. 1 shows the plasma nitridation system utilized in the present invention. A waveguide is used to transfer microwave power from a 2.45 GHz microwave generator 12 through a 3-port. circulator (not shown) to the resonant cavity 10. The amount of microwave power transferred to the resonant cavity of the quartz tube 16 can be adjusted from zero to more than 3 kW. Nitrogen gas to define the atmosphere within the quartz tube is provided through a tube 18 to one end 20 of the quartz tube; this gas flows through the quartz tube to the resonant microwave cavity. Nitrogen plasma is generated inside the quartz tube by microwave discharge. The quartz tube 16 guides the nitrogen plasma from the cavity into the nitridation ambient 22 and to the surface of the silicon wafer 24. The resonant cavity is tuned by conductive pins indicated generally at 26 to enable the plasma to extend to the surface of the silicon wafer and maximize its intensity for a fixed incident microwave power. A doped silicon rod 28 is provided at the same end of the quartz tube as the gas inlet; the silicon rod 28 functions as an anodization electrode. It is electrically connected to a dc power supply 30 whose voltage can vary from zero to 1000 volts.

The nitridation chamber itself 32 is made of stainless steel and has four ports. One port 34 is connected to a pumping system 36. Another port 38 has the sample holder for wafer 24 which consists of a heater 40 and a thermocouple. The heaters 40 were powered by a temperature controller 42 to establish a constant substrate temperature during each experiment. A further port 44 provided at the top of the chamber 32 was provided for plasma-intensity monitoring using a phototransistor.

In the experiments described below, the pumping was done by a constant speed mechanical pump without the use of an optional diffusion pump. The nitrogen pressure was controlled by adjusting the flow rate of the gas. A photosensor 46 was used at the chamber port 44 for plasma intensity measurement. The silicon wafer 24 mounted on a quartz insulator, was connected to a small dc voltage source 50. This wafer functions as the second electrode of the anodization circuit by making electrical connections to its edge. The wafer was electrically isolated from the heating block and the system ground comprising the stainless steel chamber and the cavity resonator. This configuration allows the application of a small dc voltage (usually less than or equal to 50 volts) to the silicon wafer (in addition to the power supply connected to the doped silicon rod) to make the plasma currents at the wafer and at the silicon rod equal. Unless these two currents are equal, it is found that there will be undesirable interaction between nitrogen plasma and the stainless steel chamber because of lack of enough plasma confinement causing possible contamination problems. Under the typical experimental growth conditions, the plasma electrical currents measured at the wafer 24 and at the silicon rod 28 locations are equal regardless of the exact value of the dc voltage applied to the silicon wafer 24. Therefore, in order to achieve equal currents it is not necessary to adjust the wafer dc bias 50 at a finely predetermined voltage value. However, under some unusual experimental conditions (e.g., very high microwave power in excess of 1.2 kW) the plasma stream 22 may spread out of the quartz confinement parts 52. This problem will then disturb the equality balance between the two plasma currents. The equality balance can be restored by gradually increasing the wafer bias voltage 50 and monitoring the two current meters 54, 56 until their readings become equal again. If the wafer bias voltage 50 is raised beyond this minimum required value, the two plasma current levels will still remain the same and the plasma confinement condition for minimizing any contamination risk will be satisfied. Under the normal nitridation conditions, the nitrogen plasma is confined locally around the silicon wafer by quartz confinement parts 52.

In all the nitridation experiments, 2-inch n-type <100> Si wafers with resistivities in the range of 0.1 to 0.9 ohm-cm were used. The experimental conditions for ten runs are shown in Table 1. In this table, $P_i$, $P_r$, I, T, t, and P, are the incident microwave power, reflected microwave power, anodization or plasma current, substrate temperature, nitridation time, and nitrogen gas pressure in the nitridation chamber, respectively. In each experiment the reflected microwave power was minimized by tuning the waveguide stubs 14 and cavity tuning pins. In all the experiments the nitrogen gas flow was adjusted to product the desired gas pressure under constant speed pumping by a mechanical pump. The doped silicon rod voltage determined the amount of anodization current in each experiment.

By definition, positive anodization current corresponds to positively biased silicon wafer (negative voltage on the doped silicon rod). The last four runs were performed at 500° C. substrate temperature whereas in the other runs (NH) the heater was off and the wafer temperature rise due to the excited plasma species was estimated to be equal to or less than 300° C. All the runs except for VI and X were performed with anodization current and silicon wafer biased positively with respect to the silicon rod. In run VI no anodization was used and in run X the silicon was biased negatively with respect to the silicon rod.

The plasma current, if present, consists of two components. These components are the electronic and ionic currents. Considering the much higher mobility of electrons, the plasma current is expected to be dominated by the electronic current component. In each nitridation experiment, the system was pumped down after loading the silicon wafer in the nitridation chamber. Then the desired nitrogen pressure was established in the nitridation chamber by adjusting the nitrogen flow. Following heating the silicon wafer to be desired growth temperature, microwave nitrogen discharge was started by turning on the microwave power. Then the nitridation run was performed with or without anodization current. The films were then studied by optical and scanning electron microscopy, ellipsometry and grazing angle (83°) RBS. Moreover, metal-insulator-semiconductor devices were fabricated for electrical characterization purposes.

Figure 2:
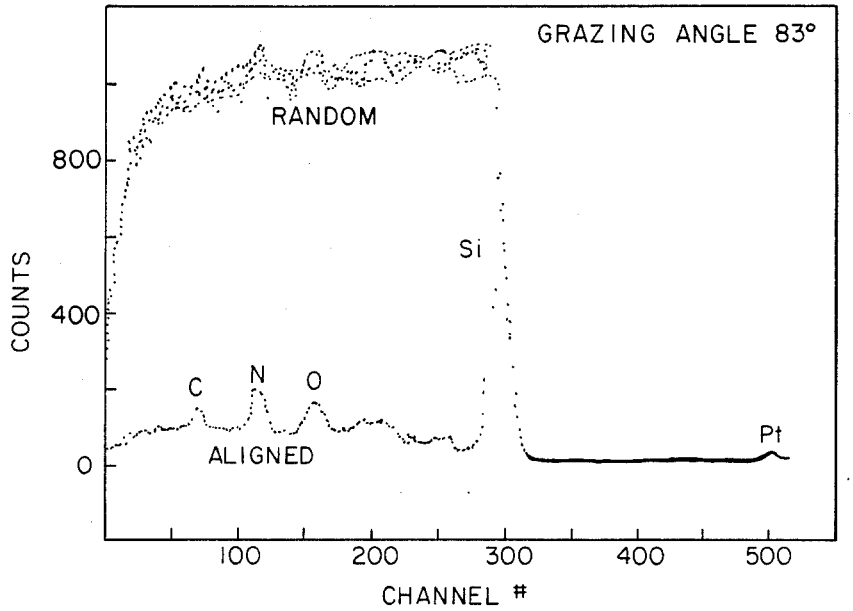
FIG. 2 is a grazing angle RBS spectra (random in line for plasma nitride sample VII)

FIG. 2 illustrates the RBS grazing angle and random spectra for the plasma nitride sample VII. The aligned spectrum indicates the presence of C, N, O, and Si in the film. Moreover, the high channel number peak indicated the presence of small amount of a heavy metal in the film. Using ESCA (XPS) it was found that the heavy metal contamination is actually due to Pt. It is possible that the Pt contamination comes from the Pt wire which makes the electrical connection to the doped silicon rod in the plasma reactor. The quantitative calculations shown that the areal concentration of Pt is several orders of magnitude less than the areal concentrations of N or Si. For instance, the areal density of Pt in the plasma nitride sample VII was found to be $4.73\times10^{13}$ atoms/cm$^2$.

The absolute areal concentrations of the elements (C, N, O, Si) were calculated from the areas of various elemental peaks in the aligned RBS spectrum. Table 2 illustrates the ellipsometry thickness and the concentration data for plasma nitrided samples of various nitridation runs. In this table, the areal silicon concentration data have been corrected for the substrate contribution to the silicon signal. Using a freshly etched clean silicon sample as RBS standard, the substrate contribution to the silicon signal was estimated to be about $2.64\times10^{16}$ atoms/cm$^2$ for 2.2 MeV incident He+ particles.

According to Table 2, the fractional nitrogen concentration ([N]/[N]+[O]+[C]) varies from 0.18 for run I to 0.48 for run IV. For all the samples except for I, IX, and X, this ratio is equal to or more than 0.40. It is expected that the dominant source of the oxygen contamination in the films is the original native oxide present on the surface of silicon prior to nitridation. The most possible explanation for carbon contamination is given based on the oil backstreaming from the mechanical pump. In order to reduce the undesirable contamination in the films, we have recently employed a diffusion pump (backed up a mechanical pump) equipped with a liquid nitrogen trap to maintain the low pressure in the nitridation chamber. This technique is expected to reduce the undesirable contamination significantly. However, all the data presented in this paper are for the samples grown in the original system pumped only with the mechanical pump. The thickness (measured with $N_f$=2.0) varied from about 30 to 100 angstroms depending on the nitridation conditions. It was concluded that the growth kinetics was almost independent of temperature. This could be observed from runs V and VII which were performed under identical growth conditions except for substrate heating used in run VII. The thicknesses in both cases are nearly the same (51 angstroms and 47 angstroms) which indicates that the growth kinetics is almost independent of temperature.

Figure 3A:
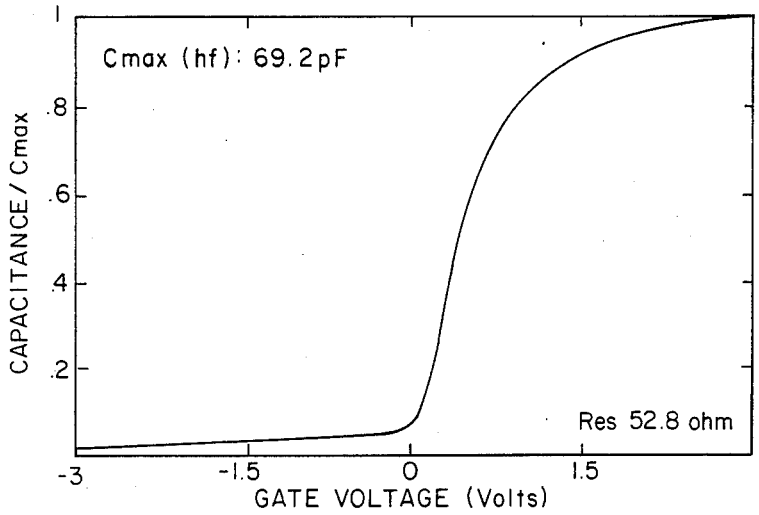
FIG. 3 shows high frequency (1 MHz) C-V characteristics of MIS devices with gate area of $7.85\times10^{-5}$ $cm^2$ (a) plasma nitride VII, (b) plasma nitride X.
Figure 3B:
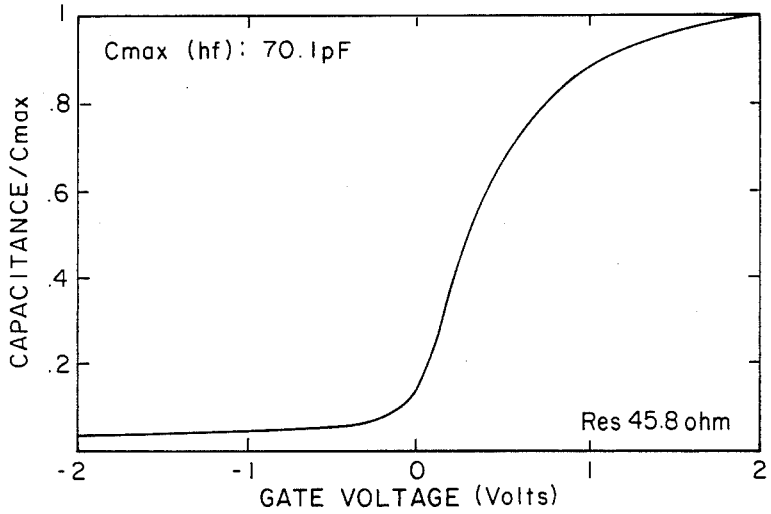
Figure 4A:
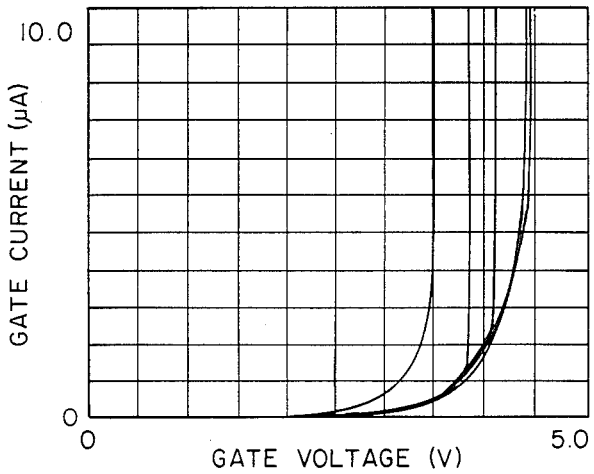
FIG. 4 is a graph of electrical breakdown characteristics for MIS devices fabricated with plasma nitride insulators (area$=7.85\times10^{-5}$ $cm^2$): (a) plasma nitride VII; (b) plasma nitride X. The results of measurements on several devices on each wafer are shown.
Figure 4B:
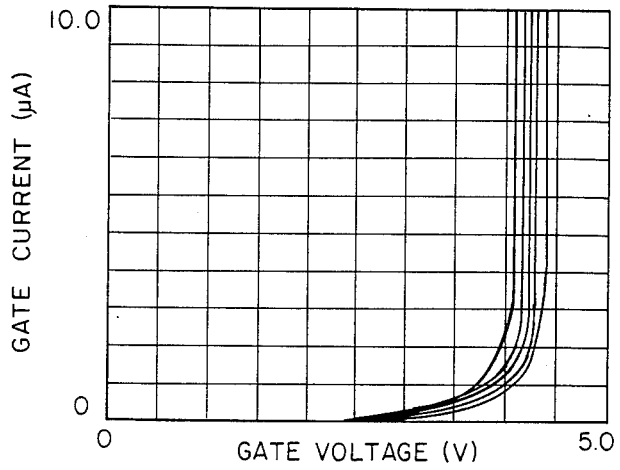
Figure 5A:
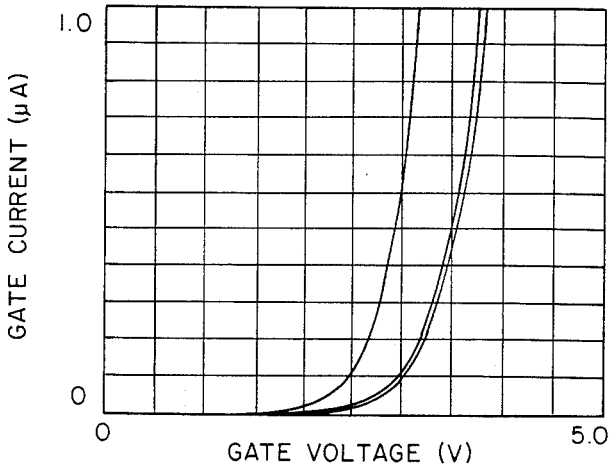
FIG. 5 shows I-V characteristics of MIS devices with (a) 47 angstrom (plasma nitride VII); and (b) 40 angstrom (plasma nitride X) plasma nitride insulators (area$=7.85\times10^{-5}$ $cm^2$); several measurement results are shown in each case.
Figure 5B:
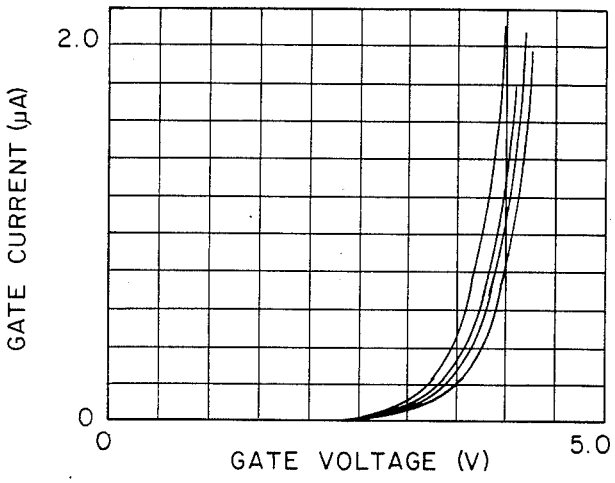

The metal-insulator-semiconductor devices were tested for electrical characterization of the plasma nitride insulators. FIGS. 3, 4, and 5 illustrate the high frequency C–V, electrical breakdown, and the I–V characteristics of the devices with the plasma nitride films VII and X.

Table 3 shows the summary of electrical characterization data obtained from MIS devices fabricated with various plasma nitride insulators. As shown in this table, the breakdown field for the plasma nitride VII was 8.9 MV/cm which is more than that (7.3 MV/cm) for V. The effect of substrate heating was to improve the electrical characteristics and the thickness uniformity across the wafer. The lowest $E_{BD}$ (3.5 MV/cm) was obtained for sample VIII which was the thickest sample grown with 140 mA of anodization current. Therefore, very large anodization current may degrade the quality of the grown insulator. The best breakdown distribution was for sample X which was grown with reverse anodization current (wafer:−, Si rod:+). The flatband and threshold voltage data in Table 3 were obtained from the C–V characteristics of various samples. The data in Table 3 indicate that the flatband voltage shifted to more positive values when no substrate heating was employed, or a very large anodization current was present during the run. The positive shift of the flatband voltage can be explained in terms of negative charge or electron trapping in the insulator. It seems that the electrons in the plasma current are trapped more easily in the insulator when the substrate temperature is low (no heating). Moreover, very large anodization current results in measurable negative charge trapping (even when substrate is heated) due to the large current density flowing through the film during the growth.

The I–V data indicated that the conduction is most possibly due to the Fowler-Nordheim injection of charge carriers. More data will be presented on time dependent breakdown, charge tapping, and oxidation resistance characteristics.

Thus, the present invention comprises a microwave discharge technique which is successful in performing direct nitridation of silicon at relatively low, i.e., no more than about 500° C. growth temperatures in nitrogen plasma ambient without the presence of hydrogen or fluorine containing species. The as-grown film show good electrical characteristics. Modifications of the present invention may become apparent to a person of skill in the art who studies this disclosure. Therefore, this invention is to be limited only by the following claims.

TABLE 1

PLASMA NITRIDATION EXPERIMENTS

| Run | $P_i$ (KW) | $P_r$ (W) | I (mA) | T (°C.) | t (min) | P (mtorrs) |
|---|---|---|---|---|---|---|
| I | 0.8 | 80 | 10 | NH | 45 | 50 |
| II | 1.2 | 60 | 30 | NH | 30 | 45 |
| III | 1.2 | 40 | 50 | NH | 80 | 65 |
| IV | 1.0 | 45 | 3.5 | NH | 180 | 73 |
| V | 1.0 | 45 | 44 | NH | 80 | 66 |
| VI | 1.0 | 45 | 00 | NH | 80 | 58 |
| VII | 1.0 | 45 | 44 | 500 | 80 | 70 |
| VIII | 1.2 | 50 | 140 | 500 | 80 | 63 |
| IX | 1.2 | 25 | 79 | 500 | 80 | 251 |
| X | 1.2 | 38 | 60 | 500 | 80 | 68 |

TABLE II

THE ELLIPSOMETRY AND RBS DATA

| Run | $t_N$(Å) | [C] (cm$^{-2}$) | [N] (cm$^{-2}$) | [O] (cm$^{-2}$) | [Si] (cm$^{-2}$) |
|---|---|---|---|---|---|
| I | 33 | $2.9\times10^{16}$ | $1.0\times10^{16}$ | $1.75\times10^{16}$ | $1.84\times10^{16}$ |
| II | 66 | $1.67\times10^{16}$ | $2.55\times10^{16}$ | $1.70\times10^{16}$ | $2.60\times10^{16}$ |
| III | 63 | $1.86\times10^{16}$ | $3.49\times10^{16}$ | $2.62\times10^{16}$ | $3.58\times10^{16}$ |
| IV | 56 | $1.73\times10^{16}$ | $3.96\times10^{16}$ | $2.54\times10^{16}$ | $4.14\times10^{16}$ |
| V | 51 | $1.55\times10^{16}$ | $1.72\times10^{16}$ | $1.06\times10^{16}$ | $0.26\times10^{16}$ |
| VI | 41 | $1.57\times10^{16}$ | $2.16\times10^{16}$ | $1.61\times10^{16}$ | $2.31\times10^{16}$ |
| VII | 47 | $1.60\times10^{16}$ | $2.69\times10^{16}$ | $1.84\times10^{16}$ | $2.94\times10^{16}$ |
| VIII | 100 | $3.61\times10^{16}$ | $5.31\times10^{16}$ | $2.95\times10^{16}$ | $4.80\times10^{16}$ |
| IX | 39 | $1.28\times10^{16}$ | $7.63\times10^{16}$ | $1.76\times10^{16}$ | $0.38\times10^{16}$ |
| X | 40 | $1.96\times10^{16}$ | $1.76\times10^{16}$ | $1.78\times10^{16}$ | $1.91\times10^{16}$ |

TABLE III

| THE ELECTRICAL CHARACTERIZATION RESULTS | | | | |
|---|---|---|---|---|
| Run | $V_{FB}$(V) | $V_{TH}$(V) | $V_{BD}$(V) | $E_{BD}$(MV/cm) |
| III | 1.53 | 0.82 | 3.7 | 5.9 |
| IV | 2.08 | 1.42 | 4.3 | 7.7 |
| V | 0.60 | 0.11 | 3.7 | 7.3 |
| VII | 0.16 | 0.54 | 4.2 | 8.9 |
| VIII | 0.71 | 0.04 | 3.5 | 3.5 |
| IX | 0.20 | 0.54 | 3.5 | 9.0 |
| X | 0.08 | 0.67 | 4.3 | 10.8 |

What is claimed is:

1. A low-temperature process for forming an ultra-thin silicon nitride film on a silicon substrate by direct plasma nitridation of silicon comprising the steps of supporting a wafer comprising said silicon substrate on a wafer support in a stainless steel nitridation chamber, leading a quartz tube from a nitrogen gas source into said plasma nitridation chamber through a resonant cavity, establishing a fluorine and hydrogen-free nitrogen atmosphere in said quartz tube, generating nitrogen plasma inside the resonant cavity of said quartz tube, said plasma extending through the quartz tube into said nitridation chamber to the surface of said wafer, inserting a silicon rod into an end of said quartz tube distant from said wafer support, and providing an electrical connection between said silicon rod and a first voltage source to produce an anodization current and an electrical connection between said wafer and a second voltage source to equalize the plasma currents at the wafer and the silicon rod to minimize contamination of said silicon nitride film.

2. A process as in claim 1 wherein the temperature of the wafer is 500° C. or less.

3. A process as in claim 1 wherein the wafer is heated to about 500° C. to improve the thickness uniformity of the wafer film.

4. A process as in claim 3 wherein said atmosphere consists of nitrogen.

5. A process as in claim 4 wherein the nitrogen plasma is generated by a microwave discharge at about 2.45 GHz.

6. A process as in claim 3 wherein the film is grown during application of reverse anodization current to said rod and said wafer.

7. A process as in claim 6 wherein the anodization current is maintained at a relatively low level.

* * * * *

UNITED STATES PATENT AND TRADEMARK OFFICE

CERTIFICATE OF CORRECTION

PATENT NO. : 4,715,937

DATED : December 29, 1987

INVENTOR(S) : M. Moslehi et al.

It is certified that error appears in the above-identified patent and that said Letters Patent is hereby corrected as shown below:

Column 1, line 5

In the specification, before the first line, insert the following sentence:

--This invention was made with Government support under contract MDA-903-84-K-0062 awarded by the Department of the Army. The Government has certain rights in this invention.--

Signed and Sealed this

Eleventh Day of April, 1995

*Attest:*

*Attesting Officer*

BRUCE LEHMAN

*Commissioner of Patents and Trademarks*